US005348502A

United States Patent [19]

Wigram

[11] Patent Number: 5,348,502

[45] Date of Patent: Sep. 20, 1994

[54] MOUNTS FOR BUOYS

[75] Inventor: Richard I. Wigram, Fleet, England

[73] Assignee: Smiths Industries Public Limited Company, London, England

[21] Appl. No.: 155,768

[22] Filed: Nov. 23, 1993

[30] Foreign Application Priority Data

Dec. 1, 1992 [GB] United Kingdom ..... 9225093

[51] Int. Cl.[5] ..... B63B 22/14

[52] U.S. Cl. ..... 441/7; 441/6

[58] Field of Search ..... 441/1, 6, 7, 8, 9, 10, 441/32; 114/221 R

[56] References Cited

U.S. PATENT DOCUMENTS

| | | | |
|---|---|---|---|
| 1,166,651 | 1/1916 | Beck | 441/7 |
| 3,425,070 | 2/1969 | Clark | 441/10 |
| 4,981,453 | 1/1991 | Krishan et al. | 441/10 |

FOREIGN PATENT DOCUMENTS

| | | | |
|---|---|---|---|
| 233580 | 4/1911 | Fed. Rep. of Germany | 441/13 |
| 4050094 | 2/1992 | Japan | 441/7 |
| 2085812 | 5/1982 | United Kingdom | 441/10 |
| 2148802 | 6/1985 | United Kingdom . | |
| 2221874 | 2/1990 | United Kingdom . | |

*Primary Examiner*—Stephen P. Avila
*Attorney, Agent, or Firm*—Pollock, VandeSande and Priddy

[57] ABSTRACT

A mounting bracket for retaining an EPIRB or similar buoy on a ship comprises a housing with a support frame pivotally mounted in the housing. The lower part of the frame has a peg engaging a recess in the underside of an enlarged central part of the buoy to prevent forward or downward movement. An upper part of the housing overhangs the upper end of the buoy to prevent upward displacement. The frame is pivoted at its lower end and is retained in the housing against the action of a spring by a hydrostatic pressure release. When the mount is submerged, the hydrostatic pressure release allows the spring to displace the frame out of the housing so that the buoy can float free. The frame is in two parts held together by a locking pin so that, when the pin is released, the buoy can be removed without releasing the hydrostatic release mechanism.

9 Claims, 4 Drawing Sheets

MOUNTS FOR BUOYS

BACKGROUND OF THE INVENTION

This invention relates to mounts for buoys and assemblies including a mount and buoy.

The invention is more particularly concerned with mounting brackets for radio beacon buoys, which allow the buoys to float free when submerged beneath water.

Emergency position indicating radio beacons (EPIRBs) are now carried by many marine vessels. The EPIRB is designed to float as a buoy and, when activated, to transmit radio signals to a satellite to enable the location of the buoy to be determined. The EPIRB may be carried loose on the vessel and manually activated in an emergency. Alternatively, the EPIRB may be mounted in a bracket, which releases the beacon automatically when the vessel sinks so that the EPIRB can float to the surface of the sea. The latter arrangement is preferable since it does not rely on the crew of the vessel having to find and activate the EPIRB.

In order to ensure that the EPIRB floats free of the vessel, it is important that the mounting bracket does not impede release of the buoy in any attitude of the vessel. The EPIRB and mounting bracket are mounted on the outside of the vessel where they are exposed to the weather but must be capable of withstanding these adverse conditions and performing reliably. The EPIRB must be retained securely in the mounting bracket but it is preferable that the buoy can be released readily for servicing when necessary.

BRIEF SUMMARY OF THE INVENTION

It is an object of the present invention to provide an improved mount for a buoy.

According to one aspect of the present invention there is provided a mount for a buoy including a housing that is adapted to be secured to a part of a marine vessel, a support frame mounted with the housing for pivotal movement between a first and a second position, the frame being adapted to support and retain the buoy in the first position, the mount including means for displacing the support frame away from the housing to the second position and a release mechanism for retaining the support frame in the first position against the action of the displacing means such that the buoy is normally retained with the mount but when the release mechanism is actuated the frame is displaced away from the housing to the second position such that the buoy can float free.

The housing preferably has a first portion overhanging a part of the buoy to prevent upward displacement of the buoy, the frame having a first member arranged to engage beneath a part of the buoy to prevent downward displacement of the buoy. The first member of the frame preferably includes a peg that is arranged to engage a recess in the buoy and prevent forward displacement of the buoy away from the frame in the first position of the frame. The frame preferably includes a second member arranged to extend vertically up a side of the buoy, the first and second members being pivotally connected with one another, and the first and second members being retained together by locking means such that when the locking means is released it enables removal of the buoy without actuation of the release mechanism. The pivotal connection of the first and second members may provide the pivotal mounting of the frame with the housing. The displacing means preferably includes a spring. The release mechanism may be a hydrostatic pressure release mechanism.

According to another aspect of the present invention there is provided an assembly comprising a mount according to the one aspect of the invention and a buoy mounted on the mount.

An assembly including a buoy on a mount will now be described, by way of example, with reference to the accompanying drawings.

DETAILED DESCRIPTION OF THE PREFERRED EMBODIMENT

Figure 1:
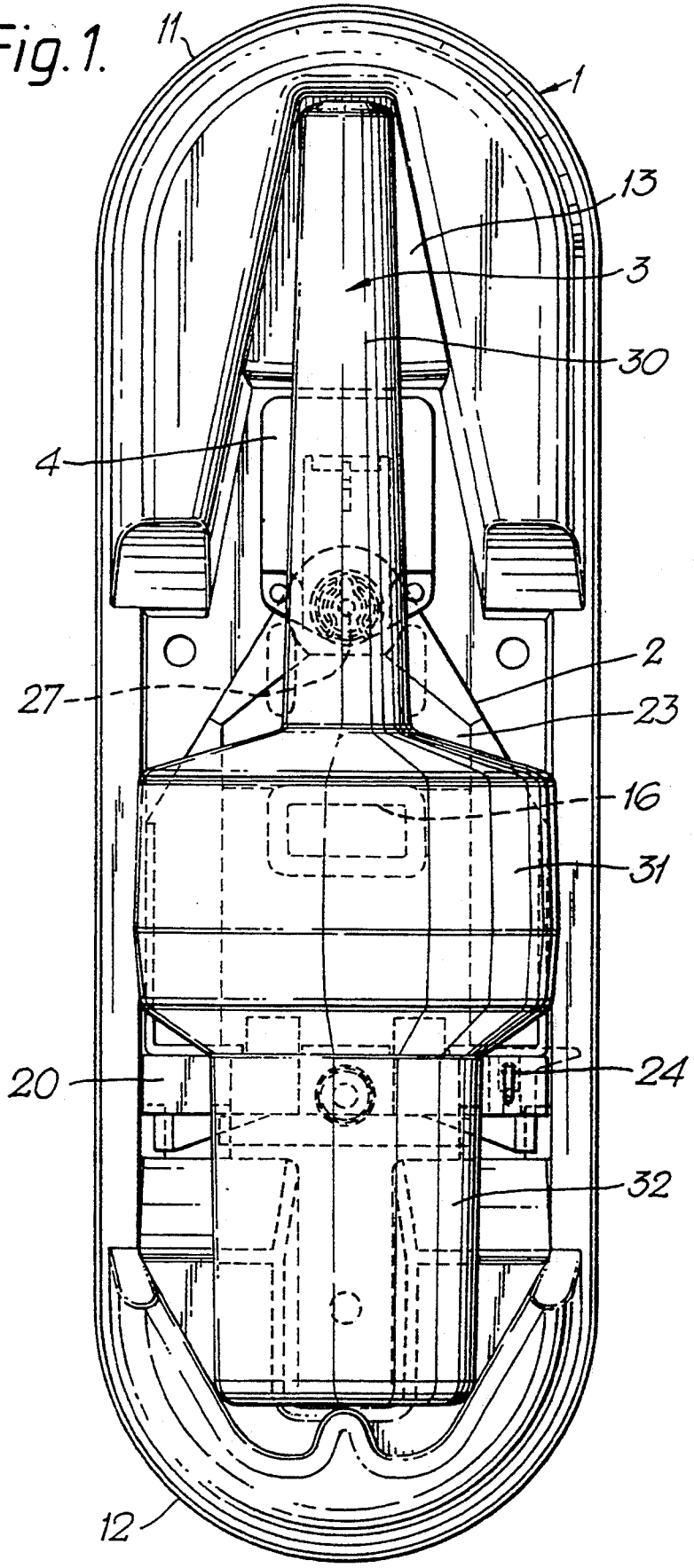
FIG. 1 is a front elevation view of the assembly.
Figure 2:
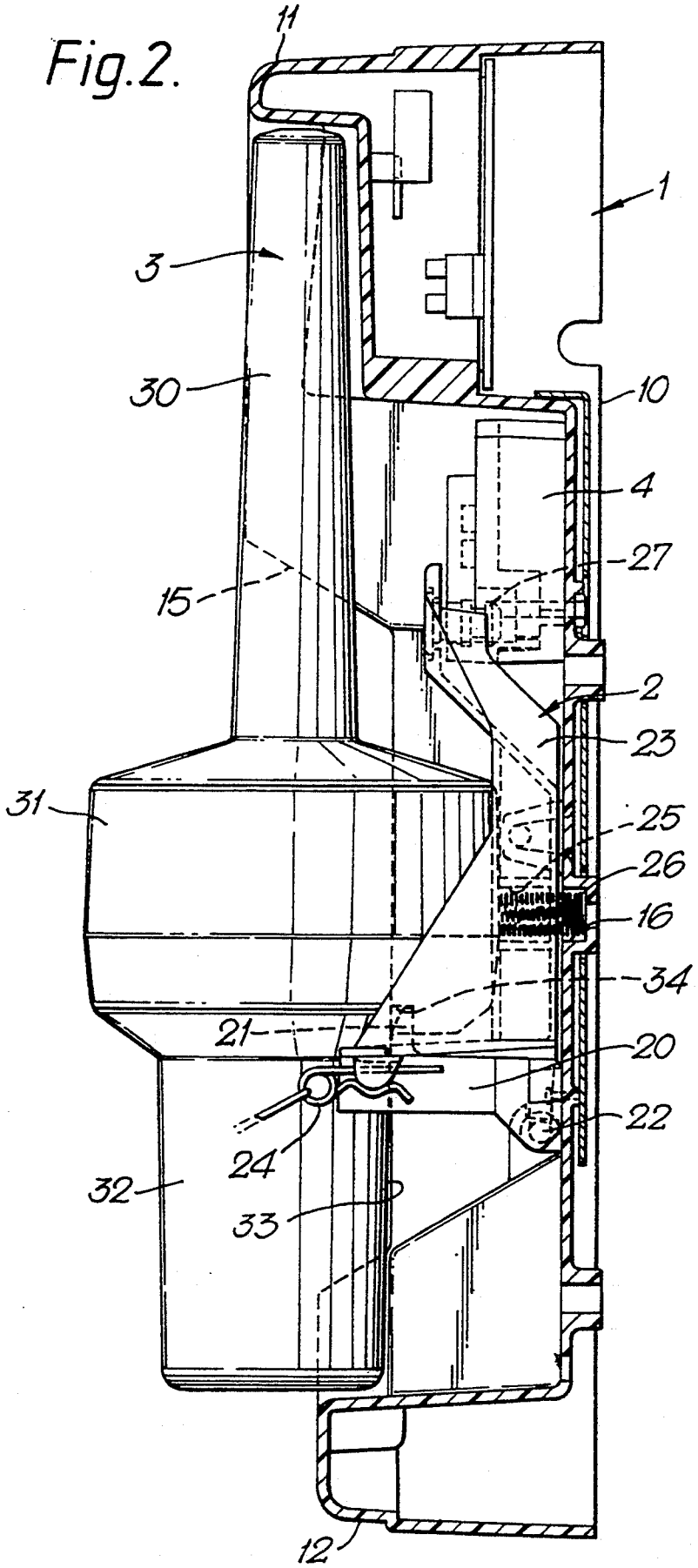
FIG. 2 is a side elevation view of the assembly.
Figure 3:
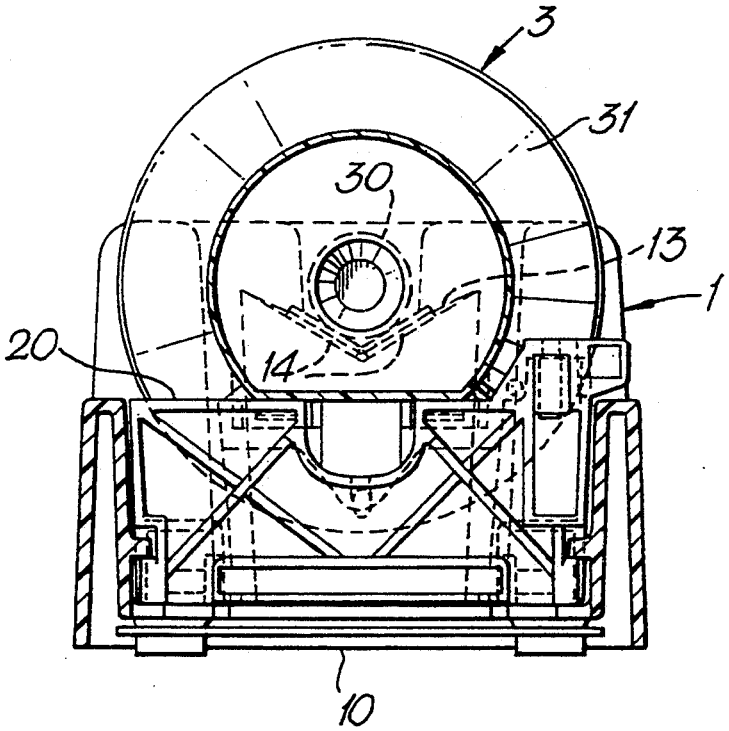
FIG. 3 is a view of the assembly from below.

With reference first to FIG. 1 to 3, the assembly includes a cast aluminum housing 1 in which is mounted a support frame 2 that carries an emergency position indicating radio beacon (EPIRB) or buoy 3. The frame 2 is retained in the housing by a hydrostatic release mechanism 4.

The buoy 3 may be of the conventional type, which transmits a radio signal on 406 MHz to a satellite receiver when it is triggered either automatically, on sinking of the vessel, or manually. The buoy 3 has a waterproof plastics housing with a slender, tapering upper portion 30 containing the antenna and a strobe light (not shown), an enlarged central portion 31 containing the electronics, and a lower portion 32 containing the batteries. The lower portion 32 is of cylindrical shape but with a flattened rear surface 33. A recess 34 is provided in the underside of the central portion 31, at a rear of the buoy, in alignment with the flattened rear surface 33 of the lower portion. When deployed, the buoy 3 floats with its lower portion 32 and the lower part of the central portion 31 submerged, and with the upper portion 30 projecting above the sea surface.

The housing 1 has a rear face 10 that is bolted to a bulkhead or other external surface of the vessel so that the housing is in a vertical orientation. The housing 1 is of generally rectangular shape with rounded upper and lower ends 11 and 12. The upper end 11 of the housing overhangs the upper portion 30 of the buoy and has a V-shape recess 13 within which is received the upper portion of the buoy, so that it is protected along the major part of its length by the depth of the recess. Two resilient foam pads 14 are secured to the housing in the recess 13. The front surface of the housing 1 slopes back over a short region 15 at a distance about one third of the length of the housing from its upper end. The lower part of the housing 1 has a shallow depth so that the buoy 3 is substantially exposed over its central portion 31 and lower portion 32.

The support frame 2 is formed in two parts. The lower part 20 provides a first member in the form of a horizontally-extending shelf which has an upwardly-projecting peg 21 towards its forward end, which locates in the recess 34 in the buoy. At its rear end, the lower part 20 has a pivoted joint 22 with the housing 1 to allow downward displacement. The upper part 23 of the frame provides a second member, which extends vertically, and is pivoted at its lower end about the same pivoted joint 22 as the lower part 20. The upper and lower parts 20 and 23 of the frame 2 are normally locked together by removable locking means in the form of a spring pin 24, so that two parts move together. The upper part 23 extends vertically up, in contact with the central portion 31 of the buoy. On the rear face of the upper part 23 there is recess 25 in which is received one end of a coiled spring 26. The other end of the spring 26 is received in a recess 16 in the housing 1 so that the spring is held in compression and provides a force urging the frame 2 away from the housing. At its upper end, the upper part 23 of the frame is inclined forwardly and is provided with a retaining bolt 27. The retaining bolt 27 normally extends within, and is retained by, the hydrostatic release 4.

The hydrostatic release 4 may of a conventional kind, which is triggered to release the bolt 27 when subject to water pressure at a depth of 1.5 to 4 m. An example of a suitable hydrostatic release is described in GB9321880 and GB9321839.

In the position shown in FIGS. 1 to 3, the buoy 3 is retained securely with the housing 1 because the peg 21 on the frame 2 holds in the buoy and prevents forward displacement, whereas the lower part 20 of the frame prevents downward movement of the buoy, and the overhanging upper part 11 of the housing prevents upward movement of the buoy. The resilient pads 14 engage the upper part 30 of the buoy and cushion it to prevent vibration. The buoy 3 is securely retained with the housing regardless of the attitude of the vessel.

If the vessel were to sink below the trigger depth of the hydrostatic release 4, the upper end of the support frame 2 would be released so that the spring 26 would displace the frame outwardly, anticlockwise about the pivot 22. As the frame 2 is displaced, it also displaces the buoy 3.

Figure 4:
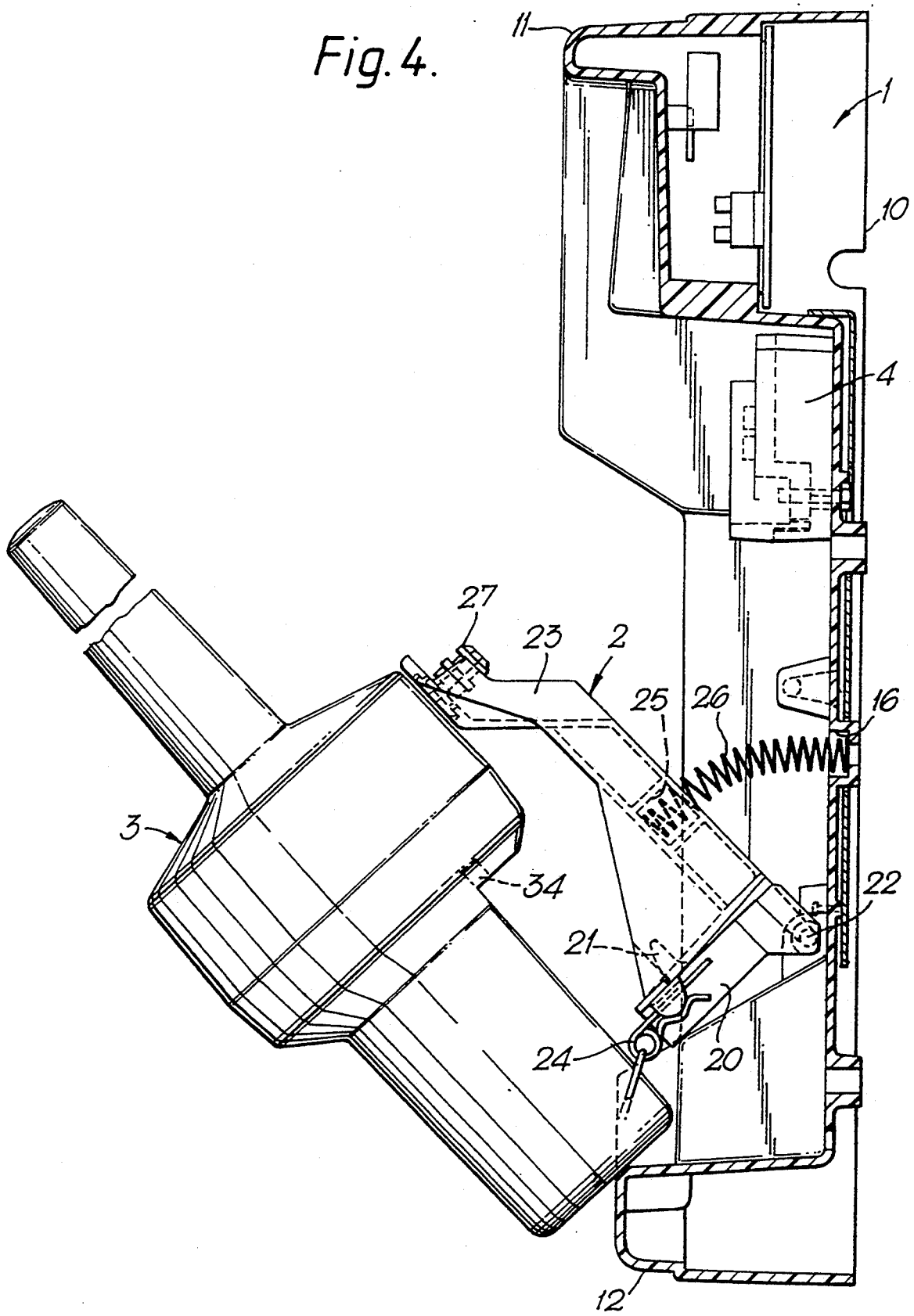
FIG. 4 is a side elevation view of the assembly showing the buoy being deployed out of the mount.

The mode of release of the buoy from the support frame will depend on the attitude of the vessel and will be assisted by the buoyancy of the buoy. It is clear, however, that when the frame 2 has moved outwardly to its full extent, as shown in FIG. 4, the peg 21 will have been withdrawn from the recess 34 because downward movement of the buoy is limited by engagement with the lower end of the housing 1. In the position shown in FIG. 4, the upper end of the buoy 3 is clear of the upper end 11 of the housing and the peg 21 on the frame 2 is clear of the recess 34 in the buoy so that there is nothing to prevent the buoy rising to the surface of the sea, whatever the attitude of the housing.

The buoy 3 can easily be released from the housing for servicing, maintenance or testing. This is achieved by pulling out the spring pin 24 so that lower part 20 of the support frame can drop down about its pivot 22 whereas the upper part 23 of the frame remains in position. As the lower part 20 drops, the peg 21 will be displaced out of the recess 34 in the buoy 3, thereby allowing the buoy to be removed from the housing. This arrangement has the advantage that it allows very easy removal of the buoy without the need to disturb the automatic release mechanism provided by the engagement of the support frame 2 with the hydrostatic release mechanism 4. The buoy 3 is also replaced very easily by holding it up to the housing, swinging the lower part 20 of the frame up until the peg 21 engages in the recess 34 of the buoy, and pushing the pin 24 back into position to lock the two parts of the support frame together.

The mount provides a secure support for the buoy while ensuring reliable release.

Various modifications are possible. For example, the housing 1 may include an electrical heater on its rear face to prevent icing of the mechanism when used in cold weather. A lightweight cover may be provided over the front of the housing, which is pushed off when the buoy and support frame are pushed outwardly. Various other techniques could be used to displace the support frame, such as compressed gas or an explosive charge. The mount could be used to support buoys other than EPIRBs.

What I claim is:

1. A mount for a buoy comprising a housing having a portion overhanging a part of the buoy, said overhanging portions being operative to prevent upward displacement of the buoy; means for securing the housing to a part of a marine vessel; a support frame adapted to support and retain the buoy in a first position against movement out of said housing, said frame having a first member arranged to engage beneath a part of the buoy to prevent downward displacement of the buoy; means mounting the support frame with the housing for pivotal movement between the first and a second position; means for displacing the support frame away from the housing to the second position; and a release mechanism for retaining the support frame in the first position against the action of the displacing means such that the buoy is normally retained with the mount but when the release mechanism is actuated the frame is displaced away from the housing to the second position such that the buoy is displaced away from the housing and can float free.

2. A mount according to claim 1, wherein said first member of the frame includes a peg shaped to engage a recess in the buoy and prevent forward displacement of the buoy away from the frame in the first position of the frame.

3. A mount according to claim 1, wherein the frame includes a second member extending vertically up a side of the buoy, means pivotally connecting the first and second members with one another, and locking means arranged to retain the first and second members together such that when the locking means is released it enables removal of the buoy without actuation of the release mechanism.

4. A mount according to claim 3, wherein the means pivotally connecting the first and second members is the means pivotally mounting the frame with the housing.

5. A mount according to claim 1, wherein the displacing means includes a spring.

6. A mount according to claim 1, wherein the release mechanism is a hydrostatic pressure release mechanism.

7. An assembly comprising a mount and a buoy, wherein the mount comprises: a housing having a portion overhanging a part of the buoy for preventing upward displacement of the buoy; means for securing the housing to a part of a marine vessel; a support frame for supporting and retaining the buoy in a first position against movement out of the housing, said frame having a member arranged to engage apart of the buoy to prevent downward displacement of the buoy; means mounting the support frame with the housing for pivotal movement between the first position and a second position; means for displacing the support frame away from the housing to the second position; and a release mechanism for retaining the support frame in the first position against the action of the displacing means such that the buoy is normally retained with the mount but when the release mechanism is actuated the frame is displaced away from the housing to the second position such that the buoy is displaced away from the housing and can float free.

8. An assembly according to claim 7, wherein the buoy is a radio beacon buoy.

9. An assembly comprising a mount and a buoy, wherein the mount comprises: a housing, said housing having a first portion overhanging an upper end of the buoy; means for securing the housing to a part of a marine vessel; a support frame, said support frame having a first member engaging beneath a part of the buoy so as to support the buoy against downward displacement and retain the buoy in a first position against movement out of the housing; means mounting the support frame with the housing for pivotal movement between the first position and a second position; a spring for displacing the support frame away from the housing to the second position; and a hydrostatic pressure release mechanism retaining the support frame in the first position against the action of the spring such that the buoy is normally retained with the mount but when the release mechanism is actuated the frame is displaced away from the housing to the second position such that the buoy is displaced away from the housing and can float free.

* * * * *